US005921448A

United States Patent [19]

Stewart

[11] Patent Number: 5,921,448

[45] Date of Patent: Jul. 13, 1999

[54] PAINT CONTAINER LID

[76] Inventor: Michael Stewart, 38 Park Ave., Bloomfield, N.J. 07003

[21] Appl. No.: 08/953,369

[22] Filed: Oct. 17, 1997

[51] Int. Cl.[6] ..... B65B 1/04

[52] U.S. Cl. ..... 222/490; 222/494; 222/570; 141/338

[58] Field of Search ..... 222/490, 494, 222/570, 460; 141/338; 220/796, 792, 700, 701; 206/508

[56] References Cited

U.S. PATENT DOCUMENTS 3,773,233 11/1973 Souza ..... 222/490
4,020,968 5/1977 Chiavola et al. ..... 222/570
4,116,332 9/1978 Hartley ..... 220/700
4,353,489 10/1982 Arnold et al. ..... 222/570
5,395,590 3/1995 Swaniger et al. ..... 222/490

*Primary Examiner*—Steven O. Douglas
*Attorney, Agent, or Firm*—Ilya Zborovsky

[57] ABSTRACT

A lid for a paint container has a body having a peripheral region engageable with an edge of the container so that the body can be mounted on the container, and a central region provided with a slot and formed so that under the action of a weight of a paint applied to the central region, the slot expands and a flow of the paint can flow through the expanded slots.

8 Claims, 3 Drawing Sheets

PAINT CONTAINER LID

BACKGROUND OF THE INVENTION

The present invention relates to paint container lids.

Paint container lids are known in the art. Some of paint container lids are disclosed in U.S. Pat. Nos. 2,715,982; 3,366,272; 3,899,107; 4,009,802; 4,034,901; 4,203,537; 4,893,723; 4,907,714; 4,949,884; 5,012,960; 5,388,715; 5,392,969. It is advisable to improver further paint container lids so as to provide on the one hand tight closure of the paint container with a lid, and on the other hand to allow easy discharge of a paint from the container.

SUMMARY OF THE INVENTION

Accordingly, it is an object of present invention to provide a paint container lid, which is a further improvement of existing paint container lids.

In keeping with these objects and with others which will become apparent hereinafter, one feature of the present invention resides, briefly stated, in a paint container lid which has an elastic region provided with a slot and formed so that normally edges of the slot are urged toward one another under the action of elasticity of the elastic material, but the edges of the slot move apart from one another under the action of weight of a paint applied to said region so as to allow a flow of the paint through the slot.

In accordance with another feature of the present invention, the region of the lid which is provided with the slot is formed as a depression, while a periphery of the lid is formed so that the lid can be engaged on a paint container in one position with the depression extending away from the interior of the container to form a spout for directing the paint toward the slot and outwardly of the lid, and another position in which the depression extends into the interior of the container to form a funnel for pouring paint toward the slot and into the container.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
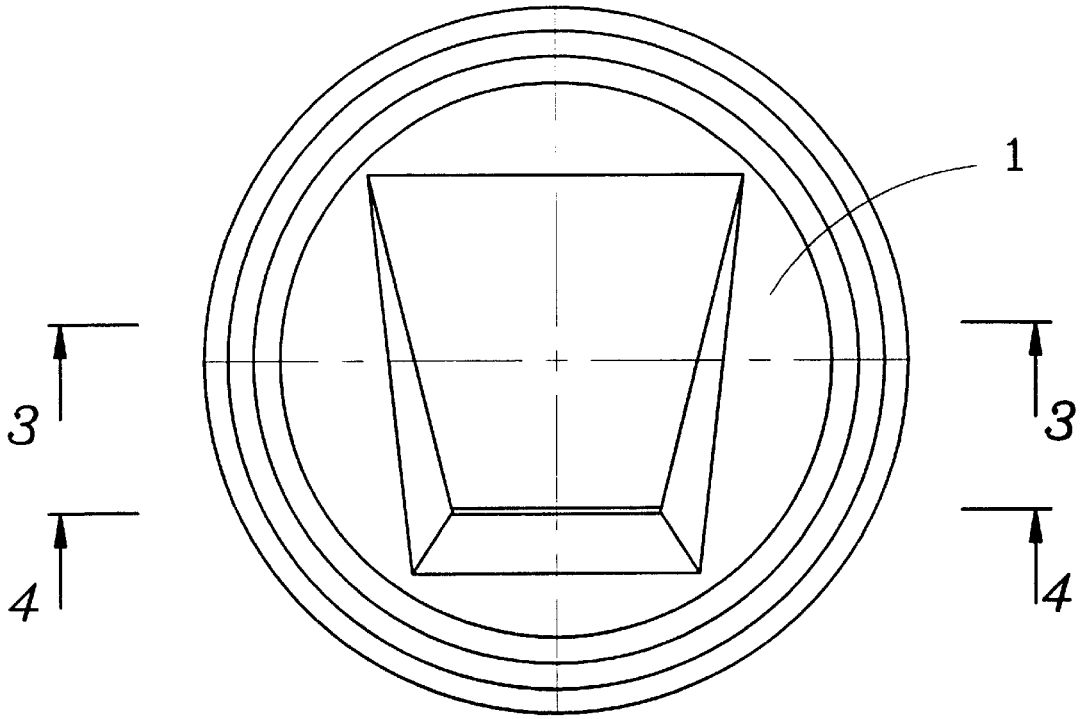
FIGS. 1 and 2 are a top view and a bottom view of a paint container lid in accordance with the present invention.
Figure 2:
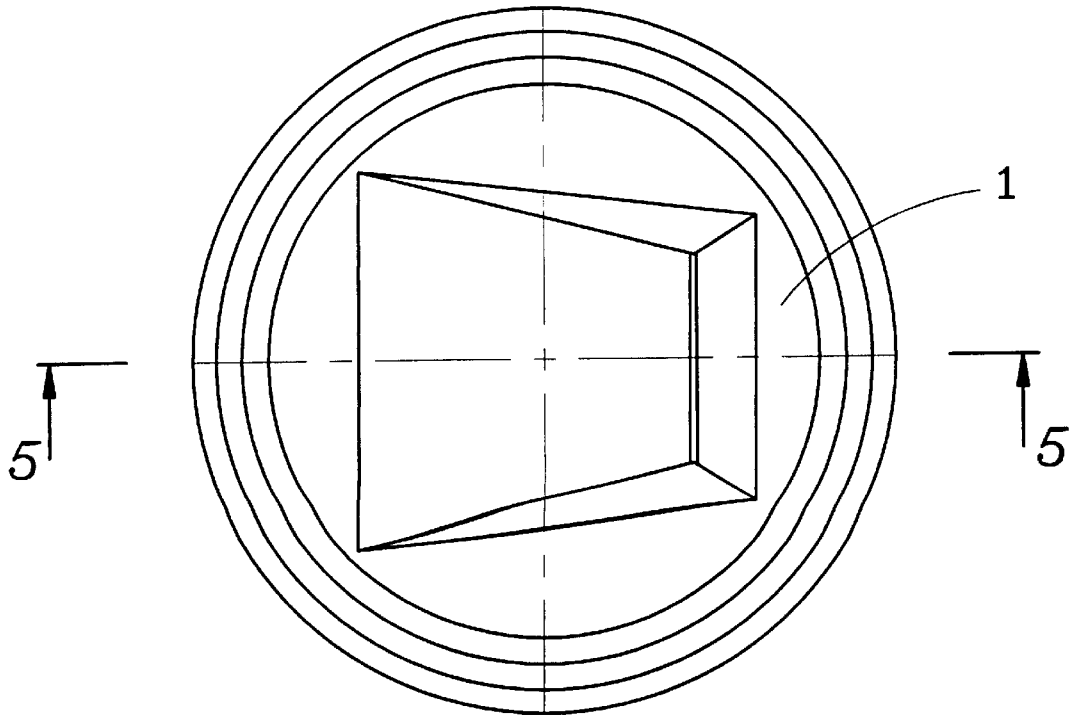

A lid for a paint container in accordance with the present invention has a body which is identified as a whole with reference numeral 1. The body 1 is formed as a one-piece element which is composed of an elastic material, such as rubber. The body is substantially disk shaped.

The body 1 has a peripheral region 2 formed by an outer cylinder 3 and an inner cylinder 4 connected with one another by a radial connecting member 5 so as to form two circular grooves 6 and 7 on one axial side and another axial side of the peripheral region 2 of the body 1. The peripheral region 2 is formed substantially mirror-symmetrical relative to a central transverse plane of the peripheral region extending perpendicular to an axis of the body. In this construction, the grooves 6 and 7 are substantially identical.

Figure 3:
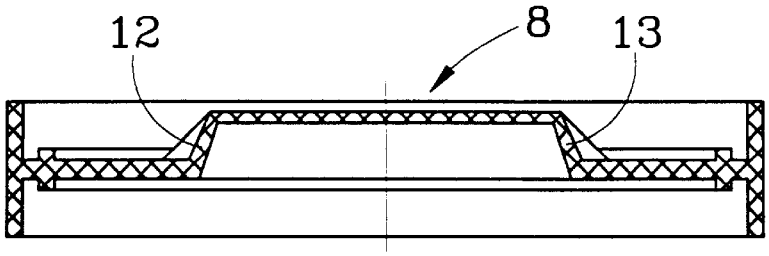
FIGS. 3, 4 and 5 are views showing cross sections of the lid in accordance with the present invention taken along the lines 3—3, 4—4 and 5—5.
Figure 4:
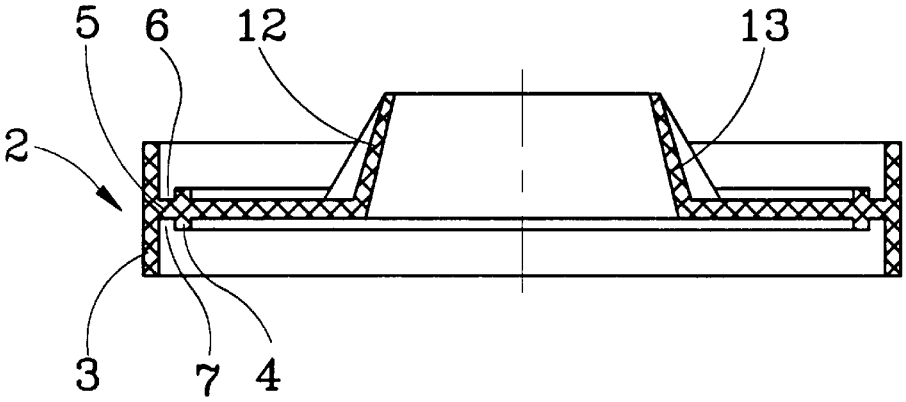
Figure 5:
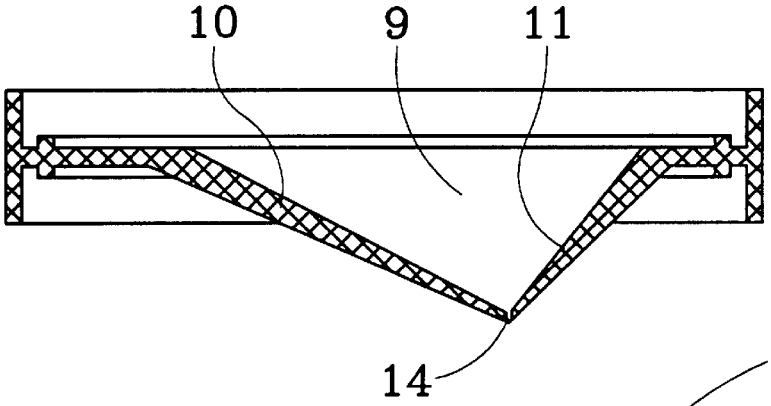

The body further has a central region which is identified with reference numeral 8. The central region is provided with a depression 9 which is formed by a first pair of inclined walls 10 and 11 shown in FIG. 3 and a second pair of a inclined walls 12 and 13 shown in FIGS. 4 and 5. The depression 9 and in a throughgoing slot 14 which is normally open. Preferably, the walls 10, 11 and 12, 13 have a thickness which reduces in direction toward the slot 14. The material of the walls surrounding the slot 14 is selected so that in a normal condition without applying any pressure of a paint or an outside object, the edges of the slot 14 either abut against one another so as to sealingly and air-tightly close the paint container, or the edges of the slot are spaced from one another by a very small distance and the slot is sealed by the paint through sealingly and air-tightly close the paint container.

Figure 6:
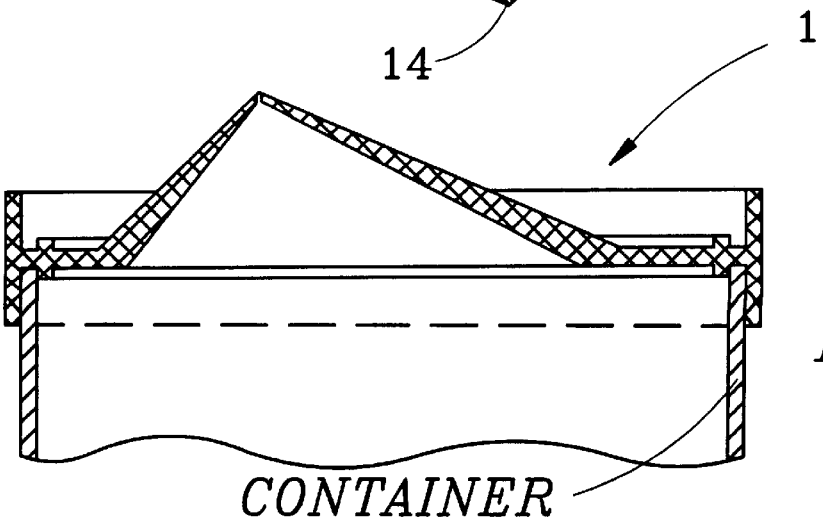
FIGS. 6 and 7 are views showing the lid in accordance with the present invention arranged on a paint container in two different positions.

When it is necessary to discharge a quantity of a paint from the container, the body 1 is placed on the container in a position shown in FIG. 6, so that its peripheral region engages the edge of the paint container with the edge of the paint container engaging into the groove 3, and the depression 9 of the central region extends away from the interior of the paint container. Then the container is tilted and the paint is poured into the depression 9 which serves as a spout, under the action of the weight of the paint the walls surrounding the slot 14 yield and the edges of the slot 14 move away from one another so that the slot expands and the paint can be poured through the thusly expanded slot and outwardly of the paint container. When it is necessary to return a remaining quantity of the paint from a paint tray into the container, the body 1 is placed on the container in a position shown in FIG. 7, so that the peripheral region of the body again engages the edge of the paint container, while the depression in the central region of the container extends inwardly of the paint container to form a funnel. When now the paint is poured from the paint tray into the thusly formed-funnel, the walls which surround the slot 14 again yield under the action of the weight of the paint, the edges of the slot move away from one another and the slot 14 expands so that the paint flows through the thusly expanded slot into the interior of the paint container.

Figure 7:
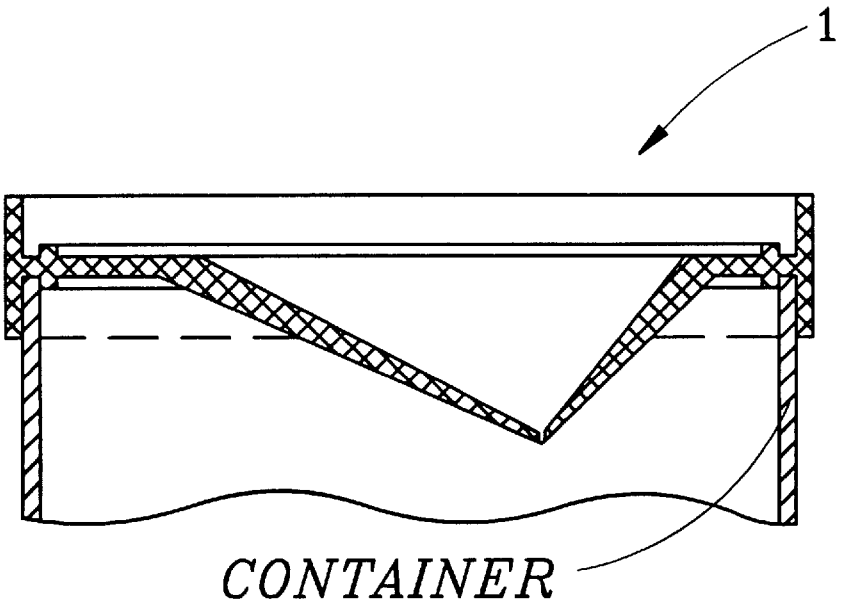
Figure 8:
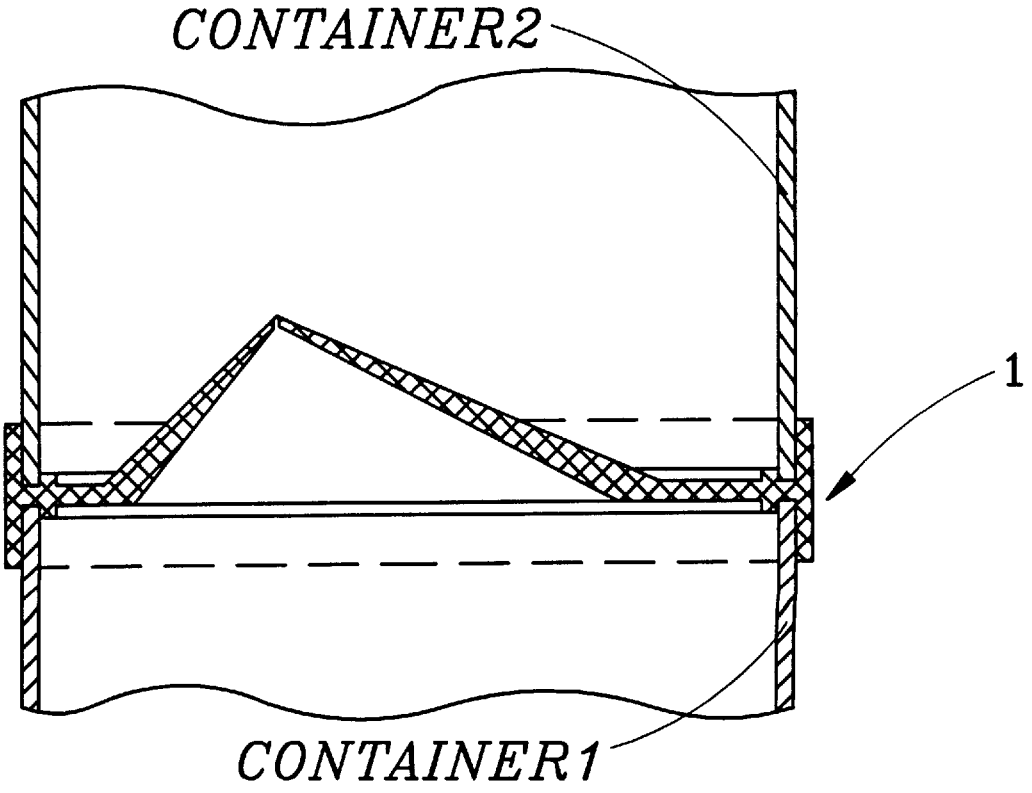
FIG. 8 is a view showing several containers nested on one another with the lid between them.

As described hereinabove, the peripheral region 2 of the body 1 is formed so that the lid can be mounted on the container in two opposite positions shown in FIGS. 6 and 7. Also, when the peripheral region 2 is formed in this manner, it is possible to nest the paint containers over one another. For example, in the position shown in FIG. 8, the body 1 is placed on the lower paint container by engaging of its groove 7 over the edge of the lower paint container, while the bottom edge of the upper paint container is engaged in the groove 6 of the peripheral region of the lid.

It will be understood that each of the elements described above, or two or more together, may also find a useful application in other types of constructions differing from the types described above.

While the invention has been illustrated and described as embodied in a paint container lid, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A lid for a paint container, comprising a body having a peripheral region engageable with an edge of the container so that said body can be mounted on the container; and a central region provided with a slot and formed so that under the action of a weight of a paint applied to said central region, said slot expands and a flow of the paint can flow through said expanded slot, said central region being provided with a description having inclined walls leading to said slot, said peripheral region being formed so that said body can be arranged on a paint container in one position in which said depression extends outwardly from an interior of the container and forms a spout so that the paint can flow from the interior of the container through said spout and through said expanded slot outwardly, and another position which said depression extends inwardly of the container and forms a funnel so that a paint can be returned into the container by pouring the paint into said funnel and through said expanded slot into the container.

2. A lid for a paint container as defined in claim 1, wherein at least said central region of said body is composed of an elastic material to allow expansion of said slot.

3. A lid for a paint container as defined in claim 2, wherein said body is composed of the elastic material which is rubber.

4. A lid for a paint container as defined in claim 1, wherein said body is formed as a one-piece element composed of an elastic material.

5. A lid for a paint container as defined in claim 1, wherein said peripheral region of said body has a first group formed on one axial side of said body and a second groove formed on another axial side of said body so as to allow arranging of said body on the edge of the paint container in said one position and said another position.

6. A lid for a paint container as defined in claim 5, wherein said peripheral region is mirror-symmetrical relative to a transverse plane extending perpendicular to an axis of said body.

7. A lid for a paint container as defined in claim 5, wherein one of said grooves is formed so that it can fit over a top edge of a paint container, while the other of said grooves is formed so that it can fit over a bottom edge of another paint container, so that said body can be placed between two adjacent paint containers and engage on the top edge and the bottom edge of the corresponding containers to arrange the containers in a nested position.

8. A lid for a paint container as defined in claim 1, wherein said walls include at least two flat inclined walls extending toward said slot.

* * * * *